US009062361B2

(12) United States Patent
Sugimura et al.

(10) Patent No.: US 9,062,361 B2
(45) **Date of Patent: *Jun. 23, 2015**

(54) SI-KILLED STEEL WIRE ROD AND SPRING EXCELLENT IN FATIGUE PROPERTIES

(75) Inventors: Tomoko Sugimura, Kobe (JP); Koichi Sakamoto, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 839 days.

This patent is subject to a terminal disclaimer.

(21) Appl. No.: 12/520,993

(22) PCT Filed: Dec. 3, 2007

(86) PCT No.: PCT/JP2007/073336

§ 371 (c)(1),
(2), (4) Date: Jun. 24, 2009

(87) PCT Pub. No.: WO2008/081673

PCT Pub. Date: Jul. 10, 2008

(65) Prior Publication Data

US 2010/0098577 A1 Apr. 22, 2010

(30) Foreign Application Priority Data

Dec. 28, 2006 (JP) ..... 2006-356310
Dec. 28, 2006 (JP) ..... 2006-356312

(51) Int. Cl.

| | |
|---|---|
| ***C22C 38/60*** | (2006.01) |
| ***C22C 38/02*** | (2006.01) |
| ***C22C 43/00*** | (2006.01) |
| ***C22C 38/04*** | (2006.01) |
| ***C21C 7/00*** | (2006.01) |
| ***C21C 7/06*** | (2006.01) |
| ***C22C 38/00*** | (2006.01) |
| ***C22C 38/06*** | (2006.01) |

(52) U.S. Cl.

CPC ..... *C22C 38/04* (2013.01); *C21C 7/0006* (2013.01); *C21C 7/06* (2013.01); *C22C 38/002* (2013.01); *C22C 38/02* (2013.01); *C22C 38/06* (2013.01)

(58) Field of Classification Search

None

See application file for complete search history.

(56) References Cited

U.S. PATENT DOCUMENTS

| | | | | |
|---|---|---|---|---|
| 4,094,666 | A * | 6/1978 | Ototani | 75/526 |
| 2006/0156864 | A1* | 7/2006 | Sakamoto et al. | 75/570 |
| 2008/0202289 | A1 | 8/2008 | Sakamoto et al. | |

FOREIGN PATENT DOCUMENTS

| | | | | |
|---|---|---|---|---|
| CN | 1836052 | A | 9/2006 | |
| EP | 1 010 769 | A1 | 6/2000 | |
| EP | 1 662 016 | A1 | 5/2006 | |
| EP | 1662016 | * | 5/2006 | C22C 38/00 |
| JP | 62 099436 | | 5/1987 | |
| JP | 62 099437 | | 5/1987 | |
| JP | 63 140068 | | 6/1988 | |
| JP | 63 186852 | | 8/1988 | |
| JP | 63-186852 | * | 8/1988 | C22C 38/18 |
| JP | 63 192846 | | 8/1988 | |
| JP | 63 227748 | | 9/1988 | |
| JP | 02-034748 | * | 2/1990 | C22C 38/02 |
| JP | 05 320827 | | 12/1993 | |
| JP | 09 310145 | | 12/1997 | |
| JP | 2000-239794 | A | 9/2000 | |
| JP | 2005 029888 | | 2/2005 | |
| JP | 2006 16639 | | 1/2006 | |
| JP | 2006 104506 | | 4/2006 | |
| JP | 2006-219709 | A | 8/2006 | |
| JP | 2006 342400 | | 12/2006 | |
| KR | 10-2006-0127068 | | 12/2006 | |
| WO | WO 2005/071120 | A1 | 8/2005 | |

OTHER PUBLICATIONS

Mishra, Steelmaking Practices and Their Influence on Properties, ASM Int'l (2002).*

English translation of JP 63-186852 (1998).*

U.S. Appl. No. 12/519,179, filed Jun. 15, 2009, Sugimura, et al.

Extended Supplementary European Search Report issued on Mar. 29, 2011 in corresponding European Application No. 07 83 2956.

Notice of Preliminary Rejection issued May 2, 2011, in Korea Patent Application No. 10-2009-7012832 (with English translation).

European Search Report issued Dec. 12, 2011, in EP 20110008115 filed Dec. 3, 2007.

Chinese Office Action issued Mar. 31, 2012 in patent application No. 201010569514.0 with English translation.

Office Action issued Apr. 27, 2012 in Chinese Application No. 200780045339.1 (With English Translation).

Notice of Preliminary Rejection issued on Sep. 27, 2011, in Korean Patent Application No. 10-2011-7015446, filed Jul. 4, 2011 with English translation.

* cited by examiner

*Primary Examiner* — Yoshitoshi Takeuchi

(74) *Attorney, Agent, or Firm* — Oblon, McClelland, Maier & Neustadt, L.L.P.

(57) ABSTRACT

A Si-killed steel wire rod for obtaining a spring excellent in fatigue properties and a spring excellent in fatigue properties obtained from the steel wire rod are provided.

The Si-killed steel wire rod of the present invention contains Sr: 0.03-20 ppm (means "mass ppm", hereinafter the same), Al: 1-30 ppm and Si: 0.2-4% (means "mass %", hereinafter the same) respectively, and contains Mg and/or Ca by a range of 0.5-30 ppm in total.

Also, in the Si-killed steel wire rod of the present invention, oxide-based inclusions present in the wire rod contain $SiO_2$: 30-90%, $Al_2O_3$: 2-50%, MgO: 35% or below (not inclusive of 0%), CaO: 50% or below (not inclusive of 0%), MnO: 20% or below (not inclusive of 0%) and SrO: 0.2-15% respectively, and total content of (CaO+MgO) is 3% or above.

A spring excellent in fatigue properties can be obtained by forming the spring from such steel wire rod.

3 Claims, No Drawings

SI-KILLED STEEL WIRE ROD AND SPRING EXCELLENT IN FATIGUE PROPERTIES

TECHNICAL FIELD

The present invention relates to a Si-killed steel wire rod excellent in fatigue properties and a spring obtained from this steel wire rod, which can exert high fatigue properties when it is made, for example, a high strength spring (a valve spring, in particular) or the like, and are useful as material of a valve spring for an automobile engine, a clutch spring, a brake spring, a suspension spring and a steel cord or the like wherein such properties are required.

BACKGROUND ART

In recent years, as requirement of weight reduction and high output for an automobile are more highly required, a high stress design is directed also in a valve spring, a suspension spring or the like used for an engine, a suspension or the like. Therefore, for these springs, those which are excellent in fatigue resistance properties and setting resistance properties are strongly desired to cope with increase in a load stress. In particular, with respect to a valve spring, requirement for increasing fatigue strength is very strong, and even SWOSC-V (JIS G 3566), which is regarded to be excellent in fatigue strength among conventional steels, is becoming hard to cope with.

In a wire rod for a spring wherein high fatigue strength is required, it is necessary to reduce nonmetallic inclusions which become a start point of breakage present in the wire rod as much as possible. From such a viewpoint, with respect to the steel used for such usage as described above, it is common that high cleanliness steel wherein presence of the nonmetallic inclusions described above is decreased as much as possible is used. Further, because the risk of wire breakage and fatigue breakage due to nonmetallic inclusions increases as high strengthening of material is aimed at, the requirement for reduction and miniaturization of the nonmetallic inclusions which become its main cause has become more severe.

From the viewpoint of aiming at reduction and miniaturization of hard nonmetallic inclusions in steel, a variety of technologies have been proposed so far. For example, in the Non-patent Document 1, it is described that inclusions are refined in rolling by maintaining the inclusions at glass matter and that the inclusions are present in the $CaO—Al_2O_3—SiO_2$ based component which is the composition wherein glass is stable. Also, it is proposed that lowering of the melting point of inclusions is effective in order to promote deformation of the glass portion (the Patent Document 1, for example).

Also, in the Patent Document 2, it is shown that a spring steel excellent in fatigue properties can be obtained by properly adjusting the chemical componential composition of steel while controlling quantity of Ca, Mg, (La+Ce) to a proper range, and making composition ratio of the average composition of non-metallic inclusions in steel (composition ratio of $SiO_2$, MnO, $Al_2O_3$, MgO, and CaO) a proper range.

On the other hand, in the Patent Document 3, a wire rod for a high strength spring is proposed wherein excellent "setting properties" are exerted by controlling the fundamental components of C, Si, Mn, Cr, or the like, containing one kind or more out of Ca, Mg, Ba, Sr by the range of 0.0005-0.005%, and making the size of non-metallic inclusions 20 μm or below, and etc.

In a variety of conventional technologies proposed so far, aiming of refinement by controlling the composition of inclusions to a low melting point region is centralized. For example, in $CaO—Al_2O_3—SiO_2$ three-component based inclusions, it is known that a low melting point region is present in a composition area of three components in the three component system phase diagram which is generally known, however, in a composition where any of the components becomes high, the melting point becomes high and the fatigue strength of the wire rod lowers. Such tendency is similar also in the case of $MgO—Al_2O_3—SiO_2$ three-component based inclusions.

In a variety of technologies described above, the direction for improving properties such as fatigue properties is shown. However, in the heating time and temperature during hot working, the perfect glass state cannot necessarily be kept only by controlling the composition to that as shown in the Non-patent Document 1 for example, and crystals may possibly be formed. Also, in order to cope with the needs of further strengthening of fatigue strength of steel in recent years, it is necessary to further promote deformation of the glass portion as well.

Further, with high strengthening of steel, content of Si in steel is increased, degree of difficulty of pin-point control aiming the target composition in conventionally known $CaO—Al_2O_3—SiO_2$ system is in the tendency of becoming high, and as shown in the Patent Document 4 for example, a sophisticated control such as controlling not only totally but also the dissolved component has become necessary.

Also, as a technology for making inclusions harmless (against fatigue), a technology of controlling the composition of inclusions is disclosed. For example, in the Non-patent Document 1, it has been disclosed that, in valve spring steel, if controlled to $CaO—Al_2O_3—SiO_2$ three-component based inclusions whose melting point is lower than approximately 1,400-1,500° C., they do not become the start point of fatigue failure and fatigue properties improve.

Furthermore, in the Patent Document 5, it is shown that cleanliness steel excellent in cold workability and fatigue properties can be obtained by that the average composition of non-metallic inclusions whose length (l) and width (d) ratio is $l/d \leq 5$ in L-section of rolled steel contains $SiO_2$: 20-60%, MnO: 10-80%, and either one or both of CaO: 50% or below and MgO: 15% or below.

In the Patent Document 6, it is shown that cleanliness steel excellent in cold workability and fatigue properties can be obtained by that the average composition of non-metallic inclusions whose length (l) and width (d) ratio is $l/d \leq 5$ in L-section of rolled steel is made to comprise $SiO_2$: 35-75%, $Al_2O_3$: 30% or below, CaO: 50% or below, MgO: 25% or below.

In the Patent Document 2, it is disclosed that, fatigue strength is improved by controlling $SiO_2$: 25-75%, $Al_2O_3$: 35% or below, either one or both of CaO: 50% or below and MgO: 40% or below, and MnO: 60% or below to be contained in inclusions.

In the Patent Document 1, it is disclosed that, fatigue strength is improved by controlling the melting point of the inclusions whose melting point is highest to 1,500° C. or below.

Also, with respect to the technology using a special component, there is one shown in the Patent Document 7 wherein inclusions are controlled to $Li_2O$ composition, and one shown in the Patent Document 3 wherein Ba, Sr, Ca, Mg are contained in steel.

In these conventional technologies, it is described that the composition is controlled to one wherein vitrification is easy in order to promote deformation of inclusions in hot rolling, and that inclusions are controlled to of low melting point composition in order to further promote deformation. Also, with respect to a specific inclusions composition, a $SiO_2$-based composite oxide system wherein glass is stable is shown.

However, it is not possible to cope with the needs of further strengthening of fatigue strength properties from now only by the conventional methods described above. Also, even if further lowering of the melting point is tried on a system of $SiO_2$—$Al_2O_3$—CaO—MgO—MnO or the like on which many reports have been conventionally given aiming to make inclusions of lower melting point in order to further promote deformation, the situation has already reached wherein further improvement is difficult.

Further, in the Patent Document 3 described above, utilization of Ba, Ca, Mg, Sr, or the like is cited, however, only their effect of lowering the melting point is focused and difference of each composition and the effect of compositing combination are not utilized, which results in the technology wherein the fatigue strength capable of meeting current high requirement cannot be realized.

Also, it is difficult to obtain the low melting point inclusions with those containing much $Al_2O_3$ among non-metallic inclusions, therefore it is common that the steel for obtaining such wire rod adopts so-called "Si-killed steel" deoxidizing using Si instead of Al-killed steel.

Non-patent Document 1: "182$^{nd}$ and 183$^{rd}$ Nishiyama Memorial Technical Lecture", edited by The Iron and Steel Institute of Japan, pp. 131-134.

Patent Document 1: Japanese Unexamined Patent Application Publication No. H5-320827

Patent Document 2: Japanese Unexamined Patent Application Publication No. S63-140068

Patent Document 3: Japanese Unexamined Patent Application Publication No. S63-227748

Patent Document 4: Japanese Unexamined Patent Application Publication No. H9-310145

Patent Document 5: Japanese Unexamined Patent Application Publication No. S62-99436

Patent Document 6: Japanese Unexamined Patent Application Publication No. S62-99437

Patent Document 7: Japanese Unexamined Patent Application Publication No. 2005-29888

DISCLOSURE OF THE INVENTION

Problems to be Solved by the Invention

The present invention was developed under such situation, its object is to provide a Si-killed steel wire rod for obtaining a spring or the like excellent in fatigue properties and a spring excellent in fatigue properties obtained from such steel wire rod by making entire inclusions of low melting point and easy in deformation and by making inclusions of low melting point and easy in deformation.

Means to Solve the Problems

Under such situation, the present inventors found out that it was possible to control inclusions in molten steel to a proper composition and to prevent formation of inclusions harmful also in casting by controlling concentration of Sr, Si, Al, Mg, Ca with excellent balance.

As a generality, lowering of the melting point by compositing oxides can be considered. However, it is not easy to lower the melting point of inclusions of Si-killed steel and to keep glass stable by limited components which can be controlled as the inclusions in steel, and specific means have not been realized until now. In this regard, the present inventors realized it by controlling Sr, Si, Al, Mg, Ca with optimal balance. In particular, it is important to control Sr, (Mg+Ca) respectively among Sr, Ca, Mg which were conventionally thought to be similar and to contain all. In addition, it became possible to remarkably improve fatigue strength by properly controlling Al which exerted complicated influence on stability of $SiO_2$-based glass.

In other words, a first aspect of the Si-killed steel wire rod of the present invention which could achieve the objects described above is characterized to contain Sr: 0.03-20 ppm (means "mass ppm", hereinafter the same), Al: 1-30 ppm and Si: 0.2-4% (means "mass %", hereinafter the same) respectively, and to contain Mg and/or Ca by a range of 0.5-30 ppm in total.

In the variety of Si-killed steel wire rod described above, one containing Li by a range of 0.03-20 ppm is also a preferable embodiment.

With respect to the chemical componential composition of the Si-killed steel wire rod of the present invention, it is not limited in particular as far as it is of those used for a "spring", however a wire rod, for example, containing C: 1.2% or below (not inclusive of 0%), Mn: 0.1-2.0% respectively can be cited as a preferable one. Also, such wire rod may further contain one or more kinds selected from a group consisting of Cr, Ni, V, Nb, Mo, W, Cu, Ti, Co and rare earth element. Preferable content when they are contained is different according to each element which is Cr: 0.5-3%, Ni: 0.5% or below, V: 0.5% or below, Nb: 0.1% or below, Mo: 0.5% or below, W: 0.5% or below, Cu: 0.1% or below, Ti: 0.1% or below, Co: 0.5% or below. Also, as an element for lowering viscosity of inclusions and for further exerting the effect, REM may be added by approximately 0.05% or below.

Also, as a second aspect of the present invention, the present inventors found out that the melting point of inclusions was remarkably lowered by controlling $SiO_2$, $Al_2O_3$, MgO, CaO, MnO, SrO in inclusions with excellent balance.

As a generality, lowering of the melting point by compositing oxides can be considered. However, it is not easy to lower the melting point of $SiO_2$-based inclusions wherein glass is stable by limited component which can be controlled as the inclusions in steel, and specific means have not been realized until now. In this regard, the present inventors found out that it could be realized by controlling $SiO_2$, $Al_2O_3$, MgO, CaO, MnO, SrO with optimal balance. In particular, it is important to control Sr, (Mg+Ca) respectively among Sr, Ca, Mg which were conventionally thought to be similar, and to contain all. In addition, it became possible to remarkably improve fatigue strength by properly controlling Al ($Al_2O_3$) which exerted complicated influence on stability of $SiO_2$-based glass.

In other words, a second aspect of the Si-killed steel wire rod of the present invention which could achieve the objects described above is characterized in that oxide-based inclusions present in the wire rod contain $SiO_2$: 30-90% (means mass %), $Al_2O_3$: 2-35%, MgO: 35% or below (not inclusive of 0%), CaO: 50% or below (not inclusive of 0%), MnO: 20% or below (not inclusive of 0%) and SrO: 0.2-15% respectively, and total content of (CaO+MgO) is 3% or above.

In the variety of Si-killed steel wire rods described above, one whose oxide-based inclusions present in the wire rod further contain $Li_2O$ by the range of 0.1-20% is also a preferable embodiment.

With respect to the chemical componential composition of the Si-killed steel wire rod of the present invention, it is not limited in particular as far as it is steel for a spring, however steel, for example, containing C: 1.2 mass % or below (not inclusive of 0%), Si: 0.1-4.0%, Mn: 0.1-2.0%, Al: 0.01% or below (not inclusive of 0%) respectively can be cited as a preferable one. Also, such wire rod may further contain one or more kinds of elements selected from a group consisting of Cr, Ni, V, Nb, Mo, W, Cu, Ti, Co and a rare earth element.

Components other than above (balance) are essentially Fe and inevitable impurities. Also, even if the component which does not exert a great influence on inclusions (B, Pb, Bi or the like, for example) is added to improve properties of steel, effect of the present invention can be exerted.

A spring excellent in fatigue strength can be realized by forming the spring using the Si-killed steel wire rod as described above.

Effects of the Invention

According to the first aspect of the present invention, by properly adjusting the chemical componential composition while containing Sr, entire inclusions were made of low melting point and easy in deformation, and $SiO_2$ formation became hard even if phase separation occurred in heating before and during hot rolling, thereby a Si-killed steel wire rod for obtaining a spring excellent in fatigue properties could be realized.

Also, according to the second aspect of the present invention, by properly controlling the composition of oxide-based inclusions (compositing with optimum balance), low melting point and glass state in hot rolling were kept, thereby refinement of inclusions in hot rolling was promoted and a Si-killed steel wire rod excellent in fatigue properties could be realized.

BEST MODE FOR CARRYING OUT THE INVENTION

First Embodiment

It is known that, in the wire rod with large deformation ratio in hot rolling, refinement of inclusions by extending tearing off in hot rolling is useful. Under such circumstance, the present inventors made investigations from various angles on the composition and forms of each inclusion for improving fatigue properties of springs with variation in form of inclusions by heating after solidification and heat rolling also taken into consideration. As a result, it was found out that, by properly controlling concentration of Sr, Al, Si, Mg, Ca, deformation of oxide-based inclusions in hot rolling was remarkably promoted and became easy to be refined.

It was known conventionally that addition of a fine amount of an alkaline-earth metal element such as Sr, Mg, Ca, or the like was useful for improvement of properties of a spring (the Patent Document 3, for example), however it was revealed that addition of a fine amount without consideration on the kind of component did not work, but fatigue properties of a Si-killed steel wire rod could be remarkably improved by containing them with excellent balance. In $CaO—Al_2O_3—SiO_2$ three-component based inclusions for example, it is known that a low melting point region is present in a composition area of three components in the three component system phase diagram which is generally known, however, in a composition where any of the components becomes high, the melting point of inclusions becomes high on the contrary and the fatigue properties of the wire rod are lowered. On the other hand, it is considered that, by properly controlling concentration of Sr, Al, Si, Mg, Ca, any component in the three-component based inclusions described above does not become excessively high, and the inclusions become more easily deformed compared with the case where any of the components is lacking.

As described above, the Si-killed steel wire rod of the present embodiment is characterized in containing components such as Sr, Al, Si, Mg, Ca with excellent balance, and the reasons of limiting the range of these components are as follows.

[Sr: 0.03-20 ppm]

Sr is a component indispensable for compositing inclusions and lowering the melting point. If SrO is contained in inclusions, there is an effect that stability of glass is not lowered much and the melting point is lowered. Also, even if inclusions with extremely high concentration of $SiO_2$ are formed in solidification, by containing Sr, which has strong bonding force with oxygen, in steel with high concentration of Si, there is an effect that, the melting point of a certain degree can be maintained. In order to exert these effects, 0.03 ppm Sr is necessary in the minimum. It is preferable to contain 0.2 ppm or above. On the other hand, if concentration of Sr becomes excessively high, concentration of other components of inclusions (Mg, Ca, Al, Si, Mn, or the like) is lowered, and controlling to the composition where the melting point becomes lowest becomes impossible. Therefore, concentration of Sr should be made 20 ppm or below, preferably 8 ppm or below.

[Al: 1-30 ppm]

Al has an effect of lowering the melting point of the composition of inclusions of Si-killed steel. Further, there is also an effect of controlling vitrification when concentration of CaO or the like in inclusions becomes high. Furthermore, Al is a component easily dissolved in steel compared with Ca, Sr, or the like, and the effect of inhibiting formation of inclusions with extremely high concentration of $SiO_2$ in solidification is excellent. In order to exert these effects, it is necessary to be contained by 1 ppm or above. However, if Al content becomes high, there is a risk of forming pure $Al_2O_3$ in solidification, therefore it is necessary to make it 30 ppm or below. Also, in order to control to an optimal composition where the melting point of inclusions is lowered most, it is preferable to make it 20 ppm or below.

[Si: 0.2-4%]

Si is a main deoxidizing agent in steel making of Si-killed steel and is an indispensable element for obtaining the wire rod of the present embodiment. Further, it contributes also to high strengthening and is an important element from the point that the effect of improving fatigue properties of the present embodiment is exerted remarkably. Furthermore, it is a useful element for enhancing softening resistance and improving setting resistance properties as well. In order to exert such effects, Si content is to be made 0.2% or above (preferably 2% or above). However, if Si content becomes excessive, pure $SiO_2$ may possibly be formed during solidification, and surface decarburization and surface flaws increase, therefore fatigue properties lower on the contrary. Consequently, Si is to be made 4% or below, preferably 3% or below.

[Mg and/or Ca: 0.5-30 ppm in Total]

Mg and Ca are indispensable components for making inclusions of optimal composite composition and lowering the melting point. If containing Ba solely, Mg solely, Ca solely, Al solely, inclusions become of high melting point. Therefore, it is necessary to surely contain some of them. Further, Mg and Ca have strong affinity against oxygen, and have also an effect that, when pure $SiO_2$ is formed exceptionally, it is easily reformed to a composite composition. In order to exert these effects, content (total content if both are used) of Mg and Ca (Mg, Ca solely or using both) necessarily is to be made 0.5 ppm of above. Also, it is preferable to contain both of them with each element by at least 0.1 ppm or above (total content however is 0.5 ppm or above). However, if these elements become excessive, concentration of other elements in inclusions becomes low, and optimal low melting point composition cannot be kept. Therefore, its upper limit is to be made 30 ppm (preferably 20 ppm or below).

In the Si-killed steel wire rod of the present embodiment, fatigue properties are improved by containing respective components described above with excellent balance, but it is also useful to contain Li according to necessity. Li has an effect of refining crystals in inclusions, and, in the steel of the present embodiment wherein glass is controlled stable and of low melting point, even if crystals were very exceptionally formed, it has an effect of preventing the crystals from becoming coarse. Therefore, it is also useful to contain Li. In order to exert such effects, it is preferable to contain Li by 0.2-20 ppm, however, it is considered that some effects are exerted to some degree even by addition by approximately 0.03 ppm, and it is presumed that addition of low concentration at least does not exert a harmful influence.

The present embodiment was developed on the assumption of a Si-killed steel wire rod useful as material for a spring, and its steel kind is not particularly limited, but Mn is an element contributing to deoxidization of steel, and improves quenchability and contributes to enhancing the strength. From such viewpoint, it is preferable to contain Mn by 0.1% or above. However, if Mn content becomes excessive, toughness and ductility are deteriorated, therefore it should be made 2% or below.

With respect to content of C which is a fundamental component as steel for a spring, 1.2% or below is preferable. If C content exceeds 1.2%, steel is embrittled and becomes impractical.

Those other than above fundamental components are Fe and inevitable impurities (0.02% or below S, 0.02% or below P, or the like, for example), however if necessary, it may contain one or more kinds selected from a group consisting of Cr, Ni, V, Nb, Mo, W, Cu, Ti, Co, and a rare earth element (REM). The preferable content when these are contained differs according to each element, which is, Cr: 0.5-3%, Ni: 0.5% or below, V: 0.5% or below, Nb: 0.1% or below, Mo: 0.5% or below, W: 0.5% or below, Cu: 0.1% or below, Ti: 0.1% or below, Co: 0.5% or below, REM: 0.05% or below.

Second Embodiment

As a result of investigations by the present inventors, it was also found out that if concentration of SrO, $Al_2O_3$, $SiO_2$, MgO, CaO and MnO were properly controlled and the ratio of each oxide component in oxide-based inclusions was made appropriate, deformation of oxide-based inclusions in hot rolling was remarkably promoted and refinement became easy.

It was known conventionally that to make the ratio of each oxide in oxide-based inclusions appropriate was effective for improving properties of steel (the Patent Documents 1-3, 5-7, for example), however fatigue strength did not necessarily become excellent, and it was revealed that, by containing these components with excellent balance, fatigue properties of Si-killed steel wire rod could be remarkably improved. In CaO—$Al_2O_3$—$SiO_2$ three-component based inclusions for example, it is known that a low melting point region is present in a composition area of three components in the three component system phase diagram which is generally known, however, in a composition where any of the components becomes high, the melting point of inclusions becomes high on the contrary and the fatigue properties of the wire rod are lowered.

The Si-killed steel wire rod of the present embodiment is characterized that the composition of oxide-based inclusions present in the wire rod is properly adjusted, and the reasons content of each oxide composing oxide-based inclusions is stipulated are as described below.

[SrO: 0.2-15%]

SrO is a component indispensable for compositing inclusions and lowering the melting point. If SrO is contained in inclusions, there is an effect that stabilization of glass is not deteriorated much and the melting point is lowered. In order to exert these effects, 0.2% SrO is necessary in the minimum, preferably 1% or above. On the other hand, if concentration of SrO becomes excessively high, the melting point of inclusions becomes high on the contrary. Therefore, SrO should be made 15% or below.

[$SiO_2$: 30-90%]

$SiO_2$ is a component indispensable for making glass stable inclusions, and it is necessary by 30% in the minimum. On the other hand, if $SiO_2$ content becomes excessive, a hard $SiO_2$ crystal phase is formed and extending tearing off in hot rolling is hindered, therefore it should be made 90% or below.

[$Al_2O_3$: 2-35%]

$Al_2O_3$ has an effect of lowering the melting point of the composition of inclusions of Si-killed steel. Further, it has also an effect of inhibiting crystallization when concentration of CaO or the like in inclusions becomes high. In order to exert these effects, it is necessary to be contained by 2% or above. However, if content of $Al_2O_3$ becomes excessively high, $Al_2O_3$ crystals are formed in inclusions and extending tearing off in hot rolling is hindered, therefore it should be made 35% or below.

[MgO: 35% or Below (not Inclusive of 0%), CaO: 50% or Below (not Inclusive of 0%), MgO+CaO: 3% or Above in Total Content]

MgO and CaO are indispensable components for making inclusions of optimal composite composition and lowering the melting point. Either of MgO and CaO is of high melting point singly, but has an effect of lowering the melting point of $SiO_2$-based oxide. In order to exert such an effect, 3% or above should be contained for either one or for total. However, if concentration of them becomes excessively high, the melting point of inclusions becomes high, crystals of MgO, CaO are formed, and extending tearing off during hot rolling is hindered. Therefore there is an upper limit. Because there is a difference in crystal formation performance between MgO and CaO, the upper limit is different which is to be 35% or below for MgO and 50% or below for CaO.

[MnO: 20% or Below (Not Inclusive of 0%)]

Although MnO has an effect of lowering the melting point of $SiO_2$-based oxide, it is not rather realistic to control to high concentration in high-Si steel, therefore it was made 20% or below.

In the Si-killed steel wire rod of the present embodiment, fatigue properties are improved by containing respective components described above with excellent balance, but it is also useful to contain $Li_2O$ according to necessity. The reasons of setting the range when $Li_2O$ is contained are as follows.

[$Li_2O$: 0.1-20%]

$Li_2O$ has an effect of refining crystals in inclusions, and, in the steel of the present embodiment wherein glass is controlled stable and of low melting point, even if crystals were very exceptionally formed, it has an effect of preventing the crystals from becoming coarse. Therefore, it is also useful to contain $Li_2O$. In order to exert such effects, it is preferable to contain $Li_2O$ by approximately 2% or above, it is considered that the effects are exerted to some degree even by addition by approximately 0.1%, and it is presumed that addition of low concentration at least does not cause a harmful incident. However, even if $Li_2O$ content exceeds 20% to be contained excessively, its effect saturates.

A spring excellent in fatigue properties can be realized by forming the spring using a Si-killed steel wire rod whose respective component ratios in inclusions have been properly adjusted as described above.

The present embodiment was developed on the assumption of a Si-killed steel wire rod useful as material for a spring, and its steel kind is not particularly limited, however, in order to control the composition of inclusions, it is preferable to contain Si and Mn which are deoxidizing components by 0.1% or above. Si: 1.4% or above is more preferable and 1.9% or above is further more preferable. However, if these components are contained excessively, steel becomes easy to be embrittled, therefore they should be made 4.0% or below for Si and 2.0% or below for Mn.

Although Al can be positively contained in order to perform composition control of oxide-based inclusions, if it is excessive, concentration of $Al_2O_3$ in inclusions becomes high and coarse $Al_2O_3$ which becomes the cause of wire breakage is possibly formed, therefore 0.01% or below is preferable.

With respect to content of C which is a fundamental component as steel for a spring, 1.2% or below is preferable. If C content exceeds 1.2%, steel is embrittled and becomes impractical.

Those other than above fundamental components are Fe and inevitable impurities (0.02% or below S, 0.02% or below P, or the like, for example), however if necessary, it may contain one or more kinds selected from a group consisting of Cr, Ni, V, Nb, Mo, W, Cu, Ti, Co, and a rare earth element (REM). The preferable content when these are contained differs according to each element, which is, Cr: 0.5-3%, Ni: 0.5% or below, V: 0.5% or below, Nb: 0.1% or below, Mo: 0.5% or below, W: 0.5% or below, Cu: 0.1% or below, Ti: 0.1% or below, Co: 0.5% or below. Also, as an element for lowering the viscosity of inclusions and exerting the effect more, REM may be added by approximately 0.05% or below.

A spring excellent in fatigue properties can be realized by forming the spring using a Si-killed steel wire rod whose chemical components are properly adjusted as the first and second embodiments.

Although the present invention is described below further specifically by referring to the examples, the present invention is by no means limited by the examples below and can of course be implemented with modifications properly added within the scope adaptable to the purposes described above and below, and any of them is to be included within the technical range of the present invention.

EXAMPLES

Example 1

The experiment was performed with actual machines (or on a laboratory level). That means, with the actual machines, molten steel smelted by a converter was discharged to a ladle (molten steel of 500 kg imitating the molten steel discharged from a converter was smelted, in a laboratory), various flux was added, component adjustment, electrode-heating, and argon bubbling were performed, and a smelting treatment (slag refining) was performed. Also, after other components were adjusted, Ca, Mg, Ce, Ba, Li, or the like were added during the smelting treatment according to necessity to be maintained for 5 minutes or more. A steel ingot obtained was forged and hot rolled, and a wire rod of a diameter: 8.0 mm was made.

For each wire rod obtained, Sr and Li content in steel were measured by a method described below, and an evaluation test by a rotary bending fatigue test imitating a valve spring was performed.

[Sr and Li Content in Steel]

1) When Content is 0.2 ppm (mg/kg) or Above (0.2 ppm Quantitative Lower Limit Value)

A 0.5 g sample was taken from a wire rod of an object, was put in a beaker, demineralized water, hydrochloric acid and nitric acid were added, and was thermally decomposed. After it was natural-cooled, was transferred into a 100 mL (milliliter) measuring flask, and was made a measuring solution. This measuring solution was diluted with demineralized water and Sr and Li were quantitatively analyzed using an ICP mass spectrometer (model SPQ8000: made by Seiko Instruments Inc.).

2) When Content is Below 0.2 ppm (mg/kg) (0.03 ppm Quantitative Lower Limit Value)

A 0.5 g sample was taken from a wire rod of an object, was put in a beaker, demineralized water, hydrochloric acid and nitric acid were added, and hydrolysis was performed. Thereafter acid concentration was adjusted by adding hydrochloric acid, added with methyl isobutyl keton (MIBK), shaked, and the iron content was extracted to the MIBK phase. After left to stand, only the water phase was taken out, was transferred into a 100 mL measuring flask, and was made a measuring solution. This measuring solution was diluted with demineralized water, and Sr and Li were quantitatively analyzed with the condition described above using an ICP mass spectrometer (model SPQ8000: made by Seiko Instruments Inc.).

[Fatigue Strength Test (Rupture Ratio)]

For each hot rolled wire rod (diameter: 8.0 mm), stripping (diameter: 7.4 mm)→patenting→cold wire drawing (diameter: 4 mm)→oil tempering [oil quenching and lead bathing (approximately 450° C.) tempering continuous process] were performed and a wire with 4.0 mm diameter×650 mm was manufactured. The wire obtained was subjected to treatment equivalent to strain relieving annealing (400° C.)→shot peening→200° C. low temperature annealing, thereafter the test was performed using a Nakamura Method rotational bending tester with 908 MPa nominal stress, rotational speed: 4,000-5,000 rpm, number of times of stoppage: $2\times10^7$ times. Then, for those the breakage was caused by inclusions out of those ruptured, the rupture ratio was obtained by the equation below.

Rupture ratio (%)=[number of samples broken by inclusions/(number of samples broken by inclusions+number of samples wherein the test was stopped after attaining prescribed number of times)]×100

These results are shown in Table 1 below along with the chemical componential composition of each wire rod. Also, with respect to the elements other than Sr and Li, measurement was performed in accordance with the methods described below.

C: Burning infrared absorption method

Si, Mn, Ni, Cr, V and Ti: ICP emission spectrometry method

Al, Mg, Zr and REM: ICP mass spectrometry method

Ca: Frameless atomic absorption spectrometry method

O: Inert gas fusion method

TABLE 1

| Test | Chemical componential composition (mass %, Al, Sr, Ca, Mg and Li are in mass ppm) | | | | | | | | | | | Rupture |
|---|---|---|---|---|---|---|---|---|---|---|---|---|
| No. | C | Si | Mn | P | S | Al | Sr | Ca | Mg | Li | Others | ratio (%) |
| 1 | 0.6 | 2.2 | 0.5 | 0.01 | 0.01 | 8 | 2 | 6 | 0.3 | — | — | 6 |
| 2 | 0.8 | 1.5 | 0.7 | 0.01 | 0.01 | 10 | 1 | 3 | 0 | — | — | 6 |
| 3 | 0.8 | 0.2 | 0.5 | 0.01 | 0.01 | 5 | 1.3 | 0.5 | 3 | — | — | 6 |
| 4 | 0.7 | 1.6 | 0.7 | 0.01 | 0.01 | 32 | 1.5 | 6 | 0.2 | — | — | 37 |
| 5 | 0.6 | 2.4 | 0.3 | 0.01 | 0.01 | 24 | 7 | 1 | 6 | — | — | 9 |
| 6 | 0.6 | 1.9 | 0.9 | 0.01 | 0.01 | 2 | 3 | 7 | 0.3 | — | — | 10 |
| 7 | 0.7 | 1.5 | 0.7 | 0.01 | 0.01 | 0.4 | 4 | 10 | 0.1 | — | — | 33 |
| 8 | 0.5 | 1.5 | 0.7 | 0.01 | 0.01 | 11 | 23 | 6 | 1 | — | — | 51 |
| 9 | 0.7 | 1.5 | 0.7 | 0.01 | 0.01 | 18 | 18 | 6 | 0.3 | — | — | 11 |
| 10 | 1.0 | 2.0 | 1.6 | 0.01 | 0.01 | 10 | 0.04 | 0.3 | 6 | — | — | 10 |
| 11 | 0.5 | 2.0 | 0.9 | 0.01 | 0.01 | 6 | 0 | 5 | 0 | — | — | 25 |
| 12 | 0.5 | 2.0 | 0.9 | 0.01 | 0.01 | 14 | 0 | 6 | 0.3 | — | — | 23 |
| 13 | 0.6 | 2.4 | 0.4 | 0.01 | 0.02 | 20 | 15 | 15 | 10 | — | — | 8 |
| 14 | 0.6 | 2.4 | 0.5 | 0.01 | 0.01 | 6 | 13 | 0 | 0 | — | — | 33 |
| 15 | 0.9 | 1.6 | 0.7 | 0.01 | 0.01 | 8 | 10 | 16 | 19 | — | — | 35 |
| 16 | 0.6 | 1.6 | 0.7 | 0.01 | 0.01 | 5 | 7 | 0.3 | 0 | — | — | 38 |
| 17 | 0.6 | 1.6 | 0.7 | 0.01 | 0.01 | 3 | 5 | 35 | 0.3 | — | — | 34 |
| 18 | 0.6 | 2.0 | 0.9 | 0.01 | 0.01 | 2 | 4 | 7 | 0.5 | 25 | — | 5 |
| 19 | 0.7 | 2.0 | 0.9 | 0.01 | 0.01 | 1 | 3 | 5 | 1 | 17 | — | 5 |
| 20 | 0.6 | 2.4 | 0.5 | 0.01 | 0.01 | 9 | 4 | 4 | 2 | 0.5 | — | 6 |
| 21 | 0.5 | 2.0 | 0.7 | 0.01 | 0.01 | 3 | 0.1 | 0 | 5 | 0.03 | — | 7 |
| 22 | 0.6 | 2.0 | 0.9 | 0.01 | 0.01 | 8 | 2 | 6 | 0.4 | — | Cr: 0.9, Ni: 0.25, V: 0.1 | 5 |
| 23 | 0.6 | 1.5 | 0.7 | 0.01 | 0.02 | 10 | 1 | 3 | 0 | — | Cr: 0.65, V: 0.1 | 5 |
| 24 | 0.6 | 1.9 | 0.9 | 0.01 | 0.01 | 2 | 3 | 0.4 | 7 | — | V: 0.5, Mo: 0.3 | 8 |
| 25 | 0.6 | 2.4 | 0.4 | 0.02 | 0.01 | 20 | 13 | 15 | 10 | — | V: 0.5, Ti: 0.01, W: 0.003 | 9 |
| 26 | 0.6 | 2.4 | 0.5 | 0.001 | 0.01 | 9 | 4 | 4 | 2 | 0.5 | Cr: 3, Nb: 0.1, Co: 0.01 | 4 |
| 27 | 0.8 | 1.5 | 0.7 | 0.01 | 0.01 | 10 | 1 | 3 | 0 | — | Ni: 0.5, Ce: 0.0005 | 5 |

From these results, following consideration is possible. In those in Test Nos. 1-3, 5, 6, 9, 10, 13, 18-27, it is understood that the chemical componential composition is appropriate, and the composition of inclusions is controlled to a proper region and excellent fatigue strength is obtained.

On the other hand, in those in Test Nos. 4, 7, 8, 11, 12, 14-17, the chemical componential composition deviates from a proper region and the composition of inclusions is not controlled to a proper region, therefore the result of fatigue test is not good.

In Test Nos. 4, 7, although Sr, Ca and Mg are properly controlled, concentration of Al is high or low, and the rupture ratio becomes high.

In Test Nos. 8, 11, 12, concentration of Sr is high or low, and the rupture ratio becomes high.

In Test Nos. 14, 16, although concentration of Ba and Al is appropriate, concentration of Ca and Mg is low, and the rupture ratio becomes high.

In Test Nos. 15, 17, although concentration of Ba and Al is appropriate, concentration of Ca and Mg is excessively high, and the breakage ratio becomes high. Also, in Test No. 18, concentration of Li deviates from a preferable upper limit, however the effect saturates compared with the one in Test No. 19.

Thus, it is understood that proper controlling all of Sr, Ca, Mg and Al is necessary.

Example 2

The experiment was performed with actual machines or on a laboratory level. That means, with the actual machines, molten steel smelted by a converter was discharged to a ladle (molten steel of 500 kg imitating the molten steel discharged from a converter was smelted, in a laboratory), various flux was added, component adjustment, appropriate electrode-heating (and argon bubbling) were performed, and a smelting treatment (slag refining) was performed. Also, alloy metal such as Ca, Mg, Ce, Sr, Li, or the like was added during the smelting treatment according to necessity. Then, the molten steel was casted and made a steel ingot (was casted by a mold which could obtain the cooling speed equivalent to the actual machines, on a laboratory level). A steel ingot obtained was forged and hot rolled, and a steel wire rod of a diameter: 8.0 mm was made.

For each steel wire rod obtained, the composition of oxide-based inclusions in the wire rod was measured and an evaluation test by a rotary bending fatigue test imitating a valve spring was performed. These measuring methods are as described below.

[Composition of Inclusions (but Excluding $Li_2O$)]

An L-section (a section including the axis) of each hot rolled steel wire rod was ground, composition analysis was performed for 300 oxide-based inclusions present on the ground section by an EPMA (Electron Probe Micro Analyzer), and the average value was obtained after converted to oxide. Also, those with 5% or below concentration of S were regarded as oxide-based inclusions. The measuring condition of the EPMA then is as described below.

EPMA apparatus: JXA-8621MX (made by JEOL Ltd.)
Analyzer (EDS): TN-5500 (made by Tracor Northern)
Acceleration voltage: 20 kV
Scanning current: 5 nA
Measuring method: Quantitative analysis by energy dispersion analysis (measuring the entire area of a particle)

[Measurement of $Li_2O$]

Because concentration of $Li_2O$ in inclusions could not be measured by the EPMA, an analyzing method by SIMS (Secondary Ion Mass Spectroscopy) was originally developed and the measurement was performed in a procedure described below.

(1) Primary Standard Sample

1) First, concentration of each CaO, MgO, $Al_2O_3$, MnO, $SiO_2$, SrO or the like of inclusions in steel is analyzed by an EDX, EPMA or the like.
2) The synthesized oxide with the composition same to the composition of inclusions other than $Li_2O$ and the synthesized oxide added with various $Li_2O$ to them are prepared in a large number, concentration of $Li_2O$ of them are quantitatively analyzed by chemical analysis, and standard samples are prepared.

3) The relative secondary ion strength of Li against Si of each synthesized oxide prepared is measured.

4) A calibration curve of the relative secondary ion strength of Li against Si and concentration of $Li_2O$ chemically analyzed in 1) above is drawn.

(2) Secondary Standard Sample (for Measuring Environment Correction)

5) For environment correction purpose in measuring, a standard sample wherein Li ions have been ion-implanted on a Si wafer is prepared separately, the relative secondary ion strength of Li against Si is measured, and correction is done when above 2) is performed.

(3) Actual Measurement

6) The relative secondary ion strength of Li against Si of inclusions in steel is measured, and concentration of $Li_2O$ is obtained by the calibration curve obtained in 4) above.

[Fatigue Strength Test (Rupture Ratio)]

For each hot rolled wire rod (diameter: 8.0 mm), stripping (diameter: 7.4 mm)→patenting→cold wire drawing (diameter: 4 mm)→oil tempering [oil quenching and lead bathing (approximately 450° C.) tempering continuous process] were performed and a wire with 4.0 mm diameter×650 mm was manufactured. The wire obtained was subjected to treatment equivalent to strain relieving annealing (400° C.)→shot peening→low temperature annealing, thereafter the test was performed using a Nakamura Method rotational bending tester with 908 MPa nominal stress, rotational speed: 4,000-5,000 rpm, number of times of stoppage: $2\times10^7$ times. Then, for those the breakage was caused by inclusions out of those ruptured, the rupture ratio was obtained by the equation below.

Rupture ratio (%)=[number of samples broken by inclusions/(number of samples broken by inclusions+number of samples wherein the test was stopped after attaining prescribed number of times)]×100

The chemical componential compositions of the steel wire rods are shown in Table 1 below along with the slag composition in smelting, and the composition of inclusions and fatigue properties (rupture ratio) of each steel wire rod are shown in Table 2 below respectively.

TABLE 2

| Test | Chemical component composition* (mass %) | | | | | | Slag composition (mass %) | | | | | | |
|---|---|---|---|---|---|---|---|---|---|---|---|---|---|
| No. | C | Si | Mn | P | S | Others | CaO | $Al_2O_3$ | $SiO_2$ | MnO | MgO | SrO | $LiO_2$ |
| 31 | 0.6 | 2.2 | 0.5 | 0.01 | 0.01 | — | 36 | 15 | 35 | 3 | 3 | 5 | tr |
| 32 | 0.8 | 1.5 | 0.7 | 0.01 | 0.01 | — | 21 | 15 | 50 | 6 | 3 | 3 | tr |
| 33 | 0.6 | 2.2 | 0.7 | 0.01 | 0.01 | — | 5 | 1 | 83 | 2 | 3 | 5 | tr |
| 34 | 0.6 | 2.2 | 0.5 | 0.01 | 0.01 | — | 10 | 6 | 45 | 2 | 30 | 5 | tr |
| 35 | 0.7 | 1.6 | 0.7 | 0.01 | 0.01 | — | 10 | 38 | 30 | 2 | 10 | 5 | tr |
| 36 | 0.7 | 1.6 | 0.7 | 0.01 | 0.01 | — | 20 | 30 | 35 | 2 | 3 | 4 | tr |
| 37 | 0.6 | 1.9 | 0.9 | 0.01 | 0.01 | — | 45 | 3 | 35 | 2 | 3 | 7 | tr |
| 38 | 0.6 | 1.9 | 0.9 | 0.01 | 0.01 | — | 46 | 1 | 38 | 2 | 3 | 6 | tr |
| 39 | 0.6 | 2.2 | 0.5 | 0.01 | 0.01 | — | 29 | 12 | 34 | 1 | 3 | 18 | tr |
| 40 | 0.6 | 2.2 | 0.5 | 0.01 | 0.01 | — | 30 | 10 | 34 | 2 | 3 | 15 | tr |
| 41 | 0.5 | 2.0 | 0.5 | 0.01 | 0.01 | — | 30 | 17 | 45 | 2 | 3 | 1 | tr |
| 42 | 0.8 | 2.0 | 0.7 | 0.01 | 0.01 | — | 30 | 15 | 45 | 4 | 3 | 0.5 | tr |
| 43 | 0.8 | 2.0 | 0.3 | 0.01 | 0.01 | — | 2 | 6 | 47 | 2 | 40 | 1 | tr |
| 44 | 0.6 | 2.2 | 0.6 | 0.01 | 0.01 | — | 53 | 5 | 30 | 1 | 3 | 4 | tr |
| 45 | 0.8 | 2.2 | 0.5 | 0.01 | 0.01 | — | 1 | 20 | 58 | 2 | 3 | 12 | tr |
| 46 | 0.6 | 2.1 | 0.5 | 0.01 | 0.01 | — | 35 | 12 | 35 | 2 | 3 | 5 | 5 |
| 47 | 0.6 | 2.0 | 0.4 | 0.01 | 0.01 | — | 35 | 11 | 35 | 2 | 3 | 7 | 1 |
| 48 | 0.6 | 2.2 | 0.7 | 0.01 | 0.01 | — | 2 | 1 | 80 | 2 | 1 | 4 | 7 |
| 49 | 0.6 | 2.2 | 0.5 | 0.01 | 0.01 | — | 19 | 4 | 45 | 2 | 3 | 3 | 21 |
| 50 | 0.6 | 2.0 | 0.9 | 0.01 | 0.01 | Cr: 0.9, Ni: 0.25, V: 0.1 | 35 | 10 | 38 | 2 | 3 | 5 | tr |
| 51 | 0.6 | 1.5 | 0.7 | 0.01 | 0.01 | Cr: 0.65, V: 0.1 | 20 | 15 | 51 | 6 | 3 | 2 | tr |
| 52 | 0.6 | 3.0 | 0.5 | 0.01 | 0.01 | V: 0.5, Mo: 0.3 | 5 | 1 | 80 | 2 | 3 | 5 | tr |
| 53 | 1.0 | 2.2 | 2.0 | 0.01 | 0.01 | Nb: 0.1, Ce: 0.0005, Ti: 0.01 | 10 | 7 | 47 | 2 | 26 | 5 | tr |

*Balance: Iron and inevitable impurities

TABLE 3

| Test | Steel | Inclusions composition (mass %) | | | | | | | Rupture |
|---|---|---|---|---|---|---|---|---|---|
| No. | kind | CaO | $Al_2O_3$ | $SiO_2$ | MnO | MgO | SrO | $LiO_2$ | ratio (%) |
| 31 | A | 32 | 16 | 37 | 3 | 3 | 4 | 0 | 3 |
| 32 | B | 18 | 16 | 53 | 6 | 1 | 1 | 0 | 4 |
| 33 | C | 3 | 3 | 89 | 1 | 1 | 3 | — | 4 |
| 34 | D | 7 | 9 | 49 | 2 | 24 | 5 | — | 4 |
| 35 | E | 8 | 42 | 35 | 2 | 8 | 3 | 0 | 21 |
| 36 | F | 19 | 32 | 36 | 2 | 2 | 3 | 0 | 4 |
| 37 | G | 42 | 5 | 41 | 2 | 4 | 6 | 0 | 4 |
| 38 | H | 40 | 1 | 43 | 1 | 4 | 5 | — | 22 |
| 39 | I | 26 | 13 | 39 | 1 | 1 | 17 | — | 24 |
| 40 | J | 31 | 12 | 37 | 1 | 2 | 12 | — | 4 |
| 41 | K | 26 | 17 | 47 | 2 | 3 | 0.4 | — | 4 |
| 42 | L | 25 | 17 | 48 | 2 | 4 | 0.1 | — | 17 |
| 43 | M | 2 | 9 | 48 | 1 | 37 | 1 | — | 28 |

TABLE 3-continued

| Test No. | Steel kind | Inclusions composition (mass %) CaO | $Al_2O_3$ | $SiO_2$ | MnO | MgO | SrO | $LiO_2$ | Rupture ratio (%) |
|---|---|---|---|---|---|---|---|---|---|
| 44 | N | 52 | 5 | 35 | 1 | 2 | 3 | — | 28 |
| 45 | O | 1 | 19 | 63 | 1 | 1 | 10 | — | 22 |
| 46 | P | 32 | 15 | 40 | 1 | 2 | 5 | 3 | 0 |
| 47 | Q | 33 | 14 | 39 | 2 | 3 | 5 | 0.1 | 4 |
| 48 | R | 3 | 2 | 80 | 1 | 1 | 3 | 5 | 4 |
| 49 | S | 16 | 13 | 47 | 1 | 2 | 2 | 18 | 4 |
| 50 | T | 33 | 16 | 40 | 2 | 3 | 4 | 0 | 3 |
| 51 | U | 18 | 16 | 52 | 6 | 2 | 1 | 0 | 5 |
| 52 | V | 3 | 3 | 84 | 2 | 1 | 3 | 0 | 5 |
| 53 | W | 7 | 11 | 49 | 2 | 24 | 5 | 0 | 5 |

From these results, following consideration is possible. In those in Test Nos. 31-34, 36, 37, 40, 41, 46-53, it is understood that the composition of inclusions is properly controlled and excellent fatigue strength is obtained.

On the other hand, in those in Test Nos. 35, 38, 39, 42-45, the composition of inclusions deviates from the region stipulated in the present invention, therefore the result of fatigue test is not good.

More specifically, in Test Nos. 35, 38, although concentration of $SiO_2$, CaO and MgO is properly controlled, concentration of $Al_2O_3$ is high or low, and the rupture ratio becomes high.

In Test Nos. 39, 42, SrO is high or low, and the rupture ratio becomes high.

In Test No. 43, although concentration of $SiO_2$, CaO and $Al_2O_3$ is properly controlled, concentration of MgO is too high, and the rupture ratio becomes high.

In Test No. 44, although concentration of $SiO_2$, MgO and $Al_2O_3$ is properly controlled, concentration of CaO is too high, and the rupture ratio becomes high.

In Test No. 45, although concentration of MgO, $Al_2O_3$ and SrO is properly controlled, the total of CaO+MgO is low, and the rupture ratio becomes high.

The invention claimed is:

1. A Si-killed steel wire rod excellent in fatigue properties consisting of:

Sr: 0.03-20 ppm,
Al: 1-18 ppm,
Si: 0.2-4%,
C: at most 1.2%,
Mg: at least 0.1 ppm, and
Ca: at least 0.1 ppm;
wherein the total of Mg and Ca is in a range of 0.5-30 ppm,
the balance is Fe and inevitable impurities,
optionally Mn: 0.1-2.0%, and
optionally Li: 0.03-20 ppm,
wherein ppm refers to mass ppm and % refers to mass %.

2. A Si-killed steel wire rod excellent in fatigue properties consisting of:

Sr: 0.03-20 ppm,
Al: 1-18 ppm,
Si: 0.2-4%,
C: at most 1.2%,
Mn: 0.1-2.0%,
Mg: at least 0.1 ppm,
Ca: at least 0.1 ppm;
wherein the total of Mg and Ca is in a range of 0.5-30 ppm, and
the balance is Fe and inevitable impurities;
wherein ppm refers to mass ppm and % refers to mass %.

3. A Si-killed steel wire rod excellent in fatigue properties consisting of:

Sr: 0.03-20 ppm,
Al: 1-18 ppm,
Si: 0.2-4%,
C: at most 1.2%,
Mn: 0.1-2.0%,
Li: 0.03-20 ppm,
Mg: at least 0.1 ppm,
Ca: at least 0.1 ppm;
wherein the total of Mg and Ca is in a range of 0.5-30 ppm, and
the balance is Fe and inevitable impurities;
wherein ppm refers to mass ppm and % refers to mass %.

* * * * *